United States Patent [19]

Kawashiri et al.

[11] 4,349,617

[45] Sep. 14, 1982

[54] FUNCTION SEPARATED TYPE ELECTROPHOTOGRAPHIC LIGHT-SENSITIVE MEMBERS AND PROCESS FOR PRODUCTION THEREOF

[75] Inventors: Kazuhiro Kawashiri; Yuzo Mizobuchi; Akio Higashi; Hiroshi Tamura; Keiji Takeda; Masayoshi Nagata, all of Asaka, Japan

[73] Assignee: Fuji Photo Film Co., Ltd., Kanagawa, Japan

[21] Appl. No.: 199,877

[22] Filed: Oct. 23, 1980

[30] Foreign Application Priority Data

Oct. 23, 1979 [JP] Japan ..... 54-136755
Nov. 9, 1979 [JP] Japan ..... 54-145200

[51] Int. Cl.[3] ..... G03G 5/14; G03G 5/082

[52] U.S. Cl. ..... 430/59; 430/58; 430/130; 430/95; 430/65

[58] Field of Search ..... 430/58, 59, 70, 73, 430/74, 84, 96, 130, 131, 132

[56] References Cited

U.S. PATENT DOCUMENTS

| | | | |
|---|---|---|---|
| 3,725,058 | 4/1973 | Hayashi et al. | 430/58 |
| 3,837,851 | 9/1974 | Shattuck et al. | 430/58 X |
| 4,006,019 | 2/1977 | Kanan | 430/132 |
| 4,066,455 | 1/1978 | Mey et al. | 430/59 |
| 4,251,612 | 2/1981 | Chu et al. | 430/58 X |
| 4,265,991 | 5/1981 | Hirai et al. | 430/84 X |

FOREIGN PATENT DOCUMENTS

| | | | |
|---|---|---|---|
| 2855718 | 6/1979 | Fed. Rep. of Germany | 430/84 |
| 55-7761 | 1/1980 | Japan | 430/84 |
| 1337228 | 11/1973 | United Kingdom | 430/58 |

*Primary Examiner*—Roland E. Martin, Jr.
*Attorney, Agent, or Firm*—Sughrue, Mion, Zinn, Macpeak & Seas

[57] ABSTRACT

A function separated type electrophotographic light-sensitive member and a process for production thereof are described, said member comprising an electrically conductive support, a light-sensitive layer made of a hydrogen-doped amorphous silicon semiconductor, and an organic electric charge transport layer containing at least one positive charge transport carrier selected from the group consisting of pyrazolines, aryl-alkanes, arylketones, arylamines and chalcones.

27 Claims, 14 Drawing Figures

FIG 8 (d)'

FUNCTION SEPARATED TYPE ELECTROPHOTOGRAPHIC LIGHT-SENSITIVE MEMBERS AND PROCESS FOR PRODUCTION THEREOF

BACKGROUND OF THE INVENTION

This invention relates to a function separated type electrophotographic light-sensitive member comprising an electrically conductive support, a light-sensitive layer made up of amorphous silicon and an electric charge transport layer. More particularly, it relates to a function separated type electrophotographic light-sensitive member comprising an electrically conductive support, an amorphous silicon layer, and an electric charge transport layer into which photocarriers produced in the amorphous silicon layer by irradiation with electromagnetic wave can be efficiently injected.

Light-sensitive members comprising amorphous selenium (Se) or amorphous Se doped with impurities such as As, Te, Sb, Bi, etc., or comprising of CdS, etc., have heretofore been used as electrophotographic light-sensitive members. However, these light-sensitive members suffer from many problems; for example, they are toxic, their heat stability is very poor because the photoconductive substances crystallize at 100° C. or more, and their mechanical strength is low.

Recently, therefore, a method has been developed in which amorphous silicon is used to provide an electrophotographic light-sensitive member having no toxicity, high heat stability, high mechanical strength, and high photoconductivity. However, those light-sensitive members made up of amorphous silicon (containing no dopants) are not desirable as electrophotographic light-sensitive members because their specific resistance in a dark place is as low as $10^5$ Ω·cm, and the photoconductivity thereof is small.

This is due to the fact that in the atomic arrangement of amorphous silicon, many Si-Si bonds are cut or broken, and there are many latice defects: that is, the hopping conduction of carriers owing to a high density of localized state in energy gap of $10^{20}$ $cm^{-3}$ lowers the specific resistance in darkness, and the trapping in the defects of photo-excited carriers deteriorates the photoconductivity. On the other hand, in amorphous silicon obtained by doping with hydrogen, the density of localized state in energy gap is reduced to $10^{17}$ $cm^{-3}$ or less by the compensation of the defect through the formation of Si-H bonds therein, resulting in an increase of the specific resistance in a darkness to $10^8$ Ω·cm or more, and thus the photoconductivity is improved, and physical properties desirable for an electrophotographic light-sensitive member are obtained.

However, the specific resistance in darkness of the amorphous silicon is from 1/100 to 1/1000 of that of the amorphous Se. This gives rise to the problems that the dark decay rate of the surface potential in darkness is high and the initially charged potential is low. In order to obtain a sufficient initially charged potential, therefore, it is necessary to increase the thickness of the light-sensitive layer to about 50μ or more. In general, the amorphous silicon film is produced by glow discharge or sputtering, and it takes an unduly long period of time to produce an amorphous silicon film having a thickness of 50μ or more according to such a technique, which is undesirable from an industrial viewpoint. Furthermore, such a thick amorphous silicon film is poor in flexibility and therefore, when it is provided on a support having high flexibility, cracking of the silicon film easily occurs.

SUMMARY OF THE INVENTION

In order to solve the above described problems, this invention is intended to reduce the thickness of the amorphous silicon film to be provided on the electrically conductive support, and, at the same time, to increase the initially charged potential of the light-sensitive member to such an extent so as to obtain sufficient electrophotographic characteristics.

It has now been found that the above object can be attained by laminating an organic electric charge transport layer on the light-sensitive layer.

In the function separated type electrophotographic light-sensitive member, however, in which the light-sensitive layer made up of hydrogen-doped amorphous silicon semiconductor (hereinafter a-SiH) and the organic electric charge transport layer are laminated, the sensitivity and residual potential greatly vary with the type of organic electric charge carriers contained in the organic electric charge transport layer. Therefore, all known electric charge transport media are not necessarily preferred. As a result of extensive investigations, electric charge transport carriers have been discovered capable of constituting electric charge transport media into which photocarriers generated in the a-SiH by irradiation with electromagnetic waves can efficiently be injected. Thus, the use of these electric charge transport carriers has permitted the production of electrophotographic light-sensitive members having high sensitivities and small residual potentials.

Furthermore, it has been found that a function separated type electrophotographic light-sensitive member having high initially charged potential and sensitivity and a low residual potential can be produced by the provision of a light-sensitive layer comprising a hydrogen-doped amorphous silicon semiconductor and an electric charge transport layer on an electroconductive layer followed by the heat-treatment thereof at from 100° C. to 200° C.

Thus this invention comprises a function separated type electrophotographic light-sensitive member comprising an electroconductive support, a light-sensitive layer comprising a hydrogen-doped amorphous silicon semiconductor and an organic electric charge transport layer containing at least one positive charge transport carrier selected from the group consisting of pyrazolines, aryl methanes, arylketones, arylamines and chalcones.

This invention further provides a process for the production of a functional separated type electrophotographic light-sensitive member, comprising providing, on an electrically conductive support, a light-sensitive layer comprising a hydrogen-doped amorphous silicon semiconductor and an organic electric charge transport layer containing at least one positive charge transport carrier selected from the group consisting of pyrazolines, arylalkanes, arylketones, arylamines and chalcones, and thereafter heat-treating the thus-produced laminated product at a temperature of from 100° C. to 200° C.

DETAILED DESCRIPTION OF THE INVENTION

In the light-sensitive member of this invention, in order to prevent the injection into the light-sensitive layer of electric charges by electron or positive hole carriers, an electric charge blocking layer may be provided on the a-SiH layer at the side thereof which is not in contact with the electric charge transport layer.

Figure 1:
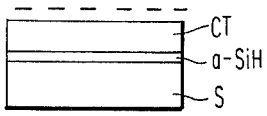
FIGS. 1 and 2 each show the structure of a light-sensitive member according to this invention.
Figure 1:
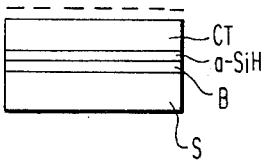
Figure 2:
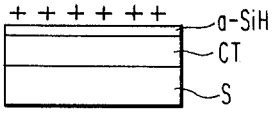
Figure 2:
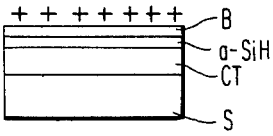

The structure of the light-sensitive member of this invention is shown in FIG. 1 or 2. In the accompanying drawings, the symbols are defined as follows:

a-SiH: Hydrogen-doped amorphous silicon semiconductor

CT: Electric charge transport layer

B: Electric charge blocking layer

S: Electrically conductive support

In FIGS. 1 and 2, (a) indicates the light-sensitive member of this invention including no electric charge blocking layer, and (b), the light-sensitive member of this invention including the electric charge blocking layer.

The light-sensitive membr of this invention as illustrated in FIG. 1-(*a*) is produced by providing an a-SiH thin film and an electric charge transport layer on an electrically conductive support in that order. In FIG. 1-(*b*), an electric charge blocking layer, an a-SiH thin film and an electric charge transport layer are provided on an electrically conductive layer in that order.

On the surface of the light-sensitive members as illustrated in FIGS. 1 and 2, there are indicated the type of electric charges which are to be charged in using the light-sensitive member.

As illustrated in the drawings, the order of the light-sensitive layer and electric charge transport layer to be provided on the electrically conductive support to provide the light-sensitive member of this invention is not critical; that is, the light-sensitive layer and electric charge transport layer may be provided in either order on the electrically conductive support.

As an electrically conductive support for the light-sensitive member of this invention, those heretofore used as supports for conventional electrophotographic light-sensitive members can be used. Examples of such electrically conductive supports include plates or films of electrically insulative substances, such as glass, ceramics and organic polymers (e.g., polyesters, polyimides, etc.), the surface of which is made electrically conductive by uniformly attaching thereon electrically conductive substances (e.g., metals such as nickel, aluminum, etc., alloys such as a nickel-chromium alloy, etc., inorganic compounds such as tin oxide, etc.), and plates, films and foils of electrically conductive substances, such as aluminum, stainless steel, chromium, zinc, etc., alone.

The film thickness of the a-SiH is usually $40\mu$ or less, usually $0.005\mu$ or more, $3\mu$ is enough in actual use, and preferably from 0.1 to $1\mu$. Because of the very high optical absorption of a-SiH, the thickness of the a-SiH as an electron generation layer is sufficient to be $3\mu$ or less, and it is not necessary to increase the thickness to more than $3\mu$. When the thickness is more than $3\mu$, the time required for the formation of film is lengthened, and the flexibility is more deteriorated with an increase in the film thickness. On the other hand, when the thickness is less than $0.005\mu$, the absorption of light is lowered because the layer is thin and, therefore, the a-SiH film cannot sufficiently work as an electric charge generation layer.

The amorphous silicon as used in this invention is characterized in that it contains hydrogen. The hydrogen content is usually 0.1 to 40 atom %, and when the amorphous silicon consists of Si and H alone, the hydrogen content is preferably from 10 to 25 atom %. The amorphous silicon as used in this invention may contain substances such as fluorine (F) in addition to H and in this case, the appropriate hydrogen content is 0.1 to 5 atom % when the content of F is 0.1 to 10 atom %. The third atom may also be O, N, Cl, I, Br or the like or combinations thereof. Usually the third atom is added up to 10 atom %, although it may be added more than 10 atom %.

The a-SiH film as used in this invention can be obtained by various methods. For example, it can be obtained by decomposing a silicon-containing compound by glow discharge and decompositing a-SiH on a substrate. As such a silicon-containing compound, those compounds represented by the general formula $SiH_xX_{4-x}$ (wherein X is F, Cl or I, and x is an integer of 0 to 4), such as $SiH_4$, $SiF_4$, $SiHF_3$, $SiH_3Cl$, $SiH_2Cl_2$, $Si_2H_6$, etc., and mixtures thereof can be used. These compounds are used usually in a gaseous form, as is or after being diluted with an inert gas, such as Ar, He or the like, and/or a gas such as $H_2$ for doping. While the amount of the diluting gas being used is not critical, the diluting gas is generally used so that it constitutes from 80 to 90 vol%. When silicon compounds containing no hydrogen are used, it is necessary to use hydrogen gas in combination therewith.

The gas pressure in a vessel wherein glow discharge is applied is generally from $10^{-2}$ to 10 Torr and preferably from 0.1 to 1 Torr. The substrate temperature is from 30° C. to 400° C., and preferably from 100° C. to 300° C. The voltage applied between the electrode and substrate is from 0.1 to 4 kV, and preferably from 0.5 to 2 kV. The current used is either a direct current or an alternating current, having a current density of from 0.005 to 100 mA/cm$^2$. In the case of the alternating current, the frequency is from 1 Hz to 4000 MHz and generally from 1 KHz to 100 MHz, and the film-forming rate is from 0.1 to 200 Å/sec, and preferably from 2 to 50 Å/sec.

Where $SiH_4$ is used as a starting material for the production of a-SiH and the a-SiH film is produced by glow discharge, the doping amount of hydrogen is 1 to 40 atomic percent and preferably 10 to 20 atomic percent. In this preferred range, the defects in the a-SiH are significantly reduced. The doping amount of hydrogen can be controlled by controlling the temperature of the substrate; that is, the substrate temperatures required for doping hydrogen within the above described ranges are, respectively, from 30° C. to 400° C., and from 100° C. to 300° C.

Figure 3:
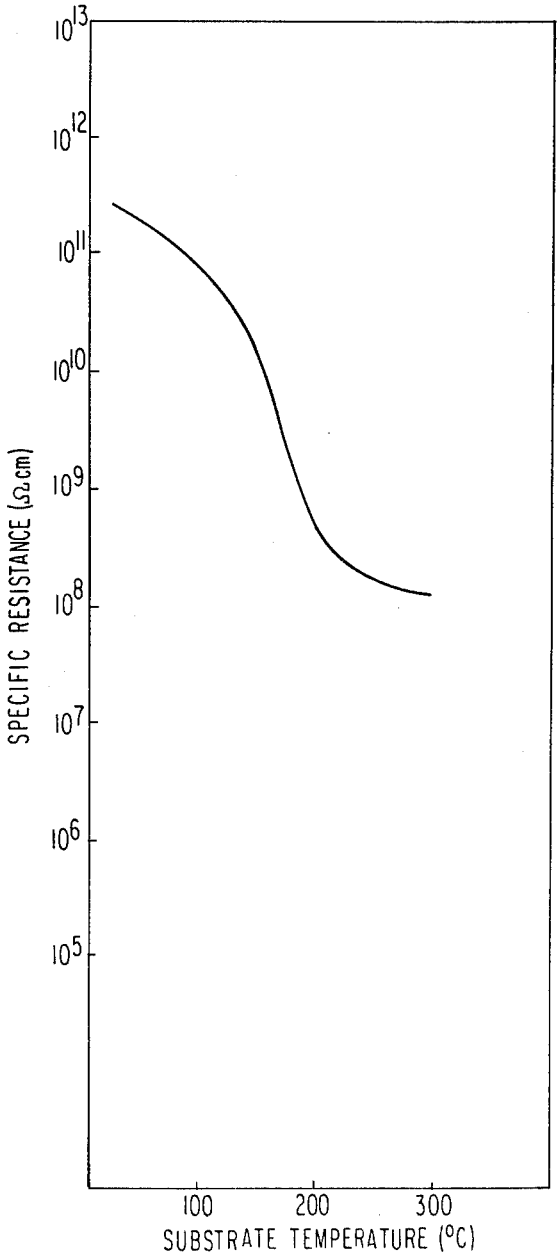
FIG. 3 is a graph showing the dependency of the specific resistance of an a-SiH film on the substrate temperature in the production of the a-SiH film by glow discharge.

Thus, a-SiH having a high resistance in darkness and excellent photoconductivity is obtained. The conduction type of the a-SiH is determined by the substrate temperature; in general, as illustrated in FIG. 3, when the temperature of the substrate is low, the a-SiH obtained is nearly intrinsic (that is, has a similar specific registance in darkness), and has a high specific resistance, and when the temmperature is high, there is obtained an a-SiH which has a somewhat small specific resistance and is of the n-type.

In order to obtain n-type a-SiH without doping with impurities, the substrate temperature is adjusted to from 100° C. to 350° C. The specific resistance of the thus obtained a-SiH is about $10^{10}$ to $10^{8}$ Ω·cm. In producing a-SiH(n) (which refers to n-type a-SiH) by doping the a-SiH with impurities, impurities such as N, P, As, Sb, Bi, etc. can be used. In this case, the corresponding compound (e.g., $NH_3$, $PH_3$, $AsH_3$, $SbCl_3$ or $BiCl_3$) gas is generally diluted to from 0.01 to 1 mol% with an inert gas, e.g., Ar, He or the like, or $H_2$ and supplied to the glow discharge vessel for the doping of a-SiH. Of these impurities for use in the doping, P is preferred from the standpoint of operation because $PH_3$, which is gaseous at ordinary temperatures, can be conveniently used.

Figure 4:
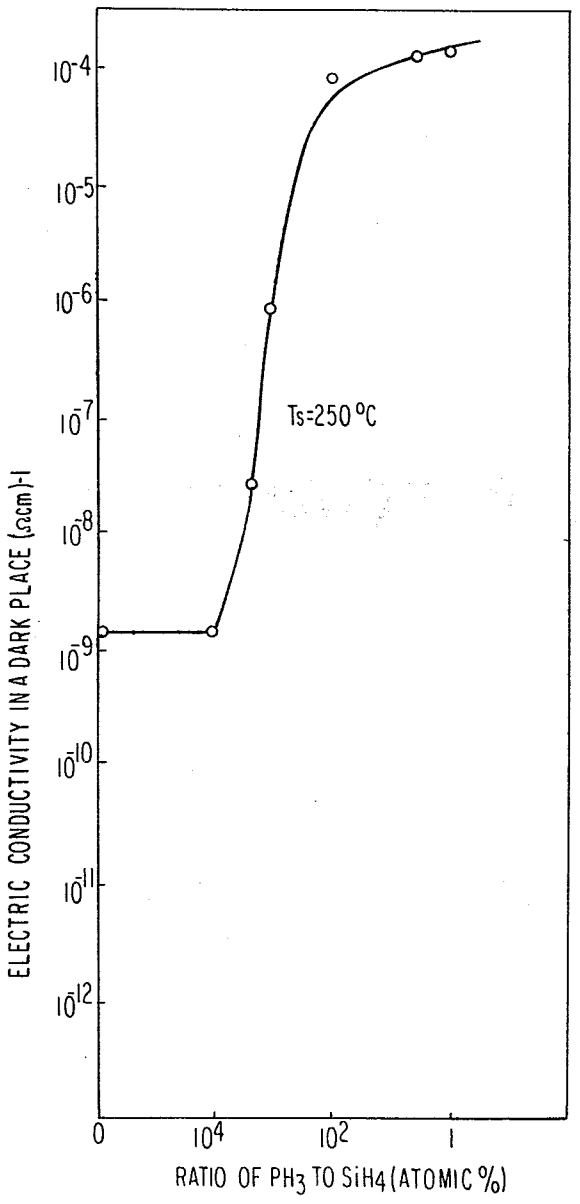
FIG. 4 is a graph showing the dependency of the electric conductivity in darkness of a-SiH on the ratio of $PH_3$ to $SiH_4$.

The amount of the impurity incorporated is generally from 0 to $10^{-2}$ mol% and preferably from 0 to $1\times10^{-3}$ mol% based upon the amount of silicon compound, although it varies with the substrate temperature as illustrated in FIG. 4. About 30 to 40% of the supplied impurity is doped in the a-SiH.

FIG. 4 shows the dependency of the electrical conductivity in darkness of the a-SiH obtained on the mol ratio (in discharging gas) of $PH_3$ to $SiH_4$. In this figure, Ts indicates the substrate temperature.

Figure 5:
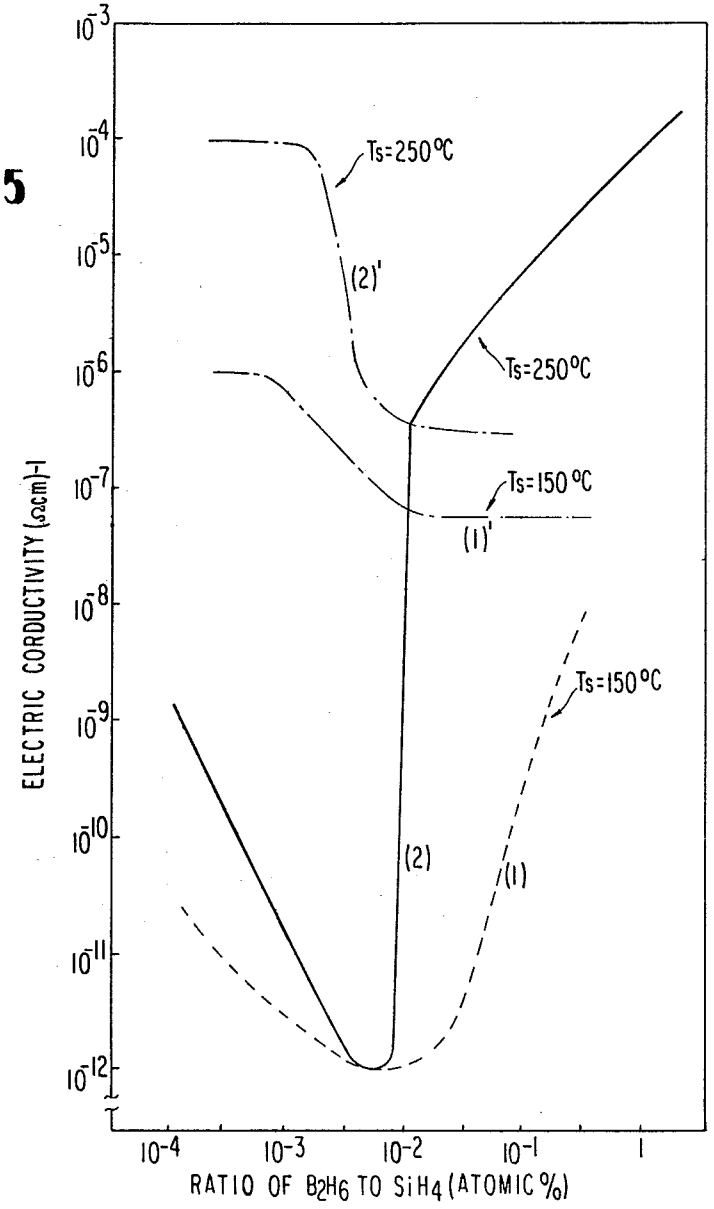
FIG. 5 is a graph showing the dependency of the electric conductivity of an a-SiH film on the ratio of $B_2H_6$ to $SiH_4$ at various temperatures in the production of the a-SiH film by glow discharge.

In obtaining more nearly intrinsic a-SiH, the a-SiH is doped with impurities such as B, Al, Ga, In, Tl, etc. according to the above described process for production of a-SiH by glow discharge. In this case, the corresponding compound gas is generally diluted to from 0.01 to 1 mol% with an inert gas, such as Ar, He or the like, or $H_2$ and introduced into the above described glow discharge vessel for the doping of the a-SiH. Where the sources for supplying the atoms are solid (e.g., $AlCl_3$, $GaCl_3$, $InCl_3$ or metallic gallium or indium), they are gasified and introduced into the glow discharge vessel. Of these impurities that can be used in the doping, B is preferred, since $B_2H_6$, $BCl_3$, $BBr_3$, $BF_3$, etc., which are gaseous at ordinary temperatures can be used.

Where $B_2H_6$ is used as an impurity, the amount of $B_2H_6$ supplied is generally from 1 to $0.8\times10^{-2}$ mol%, and preferably from $1\times10^{-2}$ to $1\times10^{-1}$ mol%, based upon the amount of silicon compound (in this case, $SiH_4$) although it varies with the substrate temperature as illustrated in FIG. 5. From about 30 to 40% of the impurity atom supplied is doped in the a-SiH.

FIG. 5 shows the dependency of the electrical conductivity of the a-SiH on the ratio (molecular percent) of the $B_2H_6$to $SiH_4$ supplied. In FIG. 5, Ts indicates the substrate temperature, Curves (1) and (2) indicate the electrical conductivities in darkness, and Curves (1)' and (2)' indicate the photoconductivities to 1 mW/cm$^2$ light of a Xe lamp. From this graph, it can be seen that the conduction type and specific resistance can be freely controlled by appropriately adjusting the amount of $B_2H_6$, by controlling the substrate temperature.

In the case of B, Al, etc., when they are supplied in small amounts, the a-SiH obtained is almost intrinsic. For example, when the ratio of $B_2H_6$to $SiH_4$ is from 0 to $1\times10^{-2}$ mol%, are preferably from $1\times10^{3}$ to $1\times10^{2}$ mol%, an almost intrinsic a-SiH having good semiconductor characteristics can be obtained.

The a-SiH as used in this invention may contain other atoms provided that its properties are within the range meeting with the requirement that it is still a semiconductor.

Figure 6:
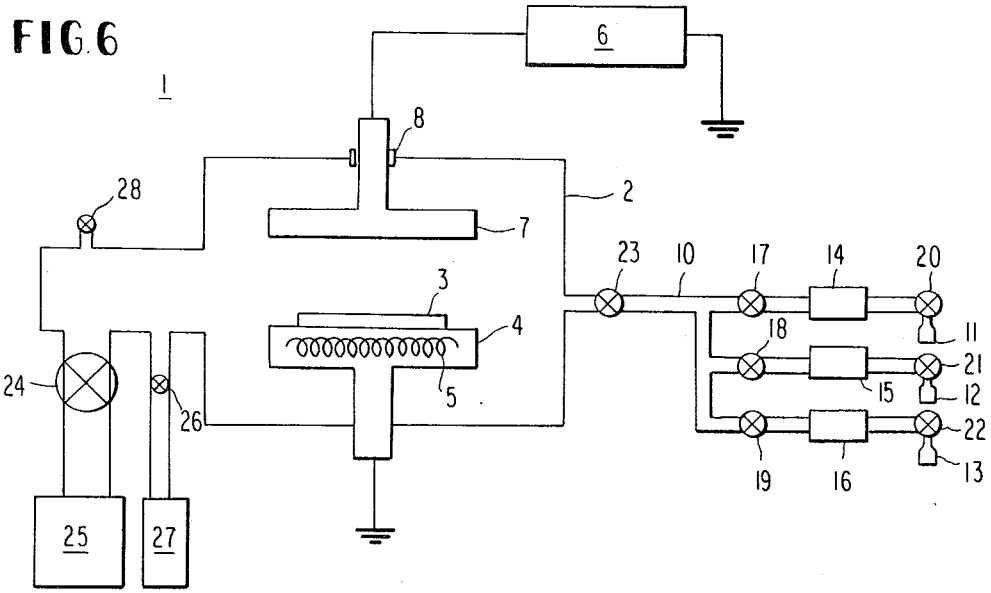
FIG. 6 is an example of a glow discharge apparatus.

An apparatus for producing an a-SiH film by the glow discharge method will hereinafter be explained. In FIG. 6, the glow discharge equipment is generally indicated by the reference number 1. In the interior of a vacuum vessel 2, a substrate 3 for forming an a-SiH film is fixed onto a substrate fixing member 4, and a heater 5 for heating the substrate is provided in the interior of the substrate fixing member 4. The discharge equipment is provided at an upper portion thereof with a capacitive type electrode 7 which is connected to a high frequency or voltage electric power supply source 6.

The electrode 7 is isolated from the vessel 2 by an insulative seal member 8. When the source 6 works and AC voltage or high voltage is applied onto the electrode 7, glow discharge occurs in the vessel 2. The vessel 2 is provided at the side wall thereof with a gas conduit 10 through which various necessary gases are introduced into the vessel 2 from gas cylinders 11, 12 and 13. The reference numerals 14, 15 and 16 indicate gas flow meters, and 17, 18 and 19 indicate needle valves for controlling flow rates. The reference numerals 20, 21 and 22 indicate reducing valves for reducing the gas pressure in the gas cylinder to atmospheric pressure to remove a light-sensitive member, and 23, an auxiliary valve. The left lower portion of the glow discharge apparatus is connected through a main valve 24 to an evacuation system 25 which allows evacuation to a a high degree of vacuum, and through a valve 26 to a low evacuation system 27, e.g., a rotary pump. The reference numeral 28 indicates a valve for the purpose of restoring atmospheric pressure of the interior of the vacuum vessel 2.

In forming a desired a-SiH photoconductive layer on the substrate 3 by use of the glow discharge apparatus, the substrate 3 is subjected to a cleaning treatment and fixed on the substrate fixing member 4 in such a manner that the cleaned surface faces electrode 7.

After the substrate is fixed, the main valve 24 is opened to evacuate the vessel 2 from atmospheric pressure to $10^{-5}$ Torr or less. Simultaneously with the evacuation, electricity is passed through the heater 5 to heat the substrate 3, and the substrate 3 is heated to a predetermined temperature and thereafter maintained at that temperature. The auxiliary valve 23 is then opened to evacuate the pipe 10. From the valves 17, 18 and 19 and the gas cylinders 11, 12 and 13 respectively, there is charged a high purity gas from each gas cylinder at a gas pressure of from 1 to 3 atm. This gas pressure is determined by the working pressure of the flow meter. The gas cylinder is charged with $SiH_4$, $Si_2H_6$, $SiH_3Cl$, $SiH_2Cl_2$, $SiF_4$, $SiF_2H_2$ or the like, a starting material for the formation of a-SiH, or a mixture thereof, usually in combination with a dilution gas, such as Ar, He, $H_2$, etc. Under certain conditions, a 100% a-SiH-forming gas may be charged.

The gas cylinders 12 and 13 are charged with gases for forming impurity atoms which are to be injected into the a-SiH photoconductive layer, such as $B_2H_6$ or $PH_3$.

The valve 23 is fully opened to evacuate the pipe 10 to a degree of vacuum of $10^{-5}$ Torr or less. Thereafter, the main valve 24 is closed and at the same time, the needle valve 17 is regulated to gradually introduce the a-SiH-forming gas into the vessel. When the gas pressure in the vessel exceeds 0.1 Torr, the valve 26 is opened to create a regular flow of the a-SiH-forming gas. Furthermore, the needle valve 17 is regulated to adjust the glow discharge gas pressure to a desired level.

After the desired gas pressure and substrate temperature are attained, when a high voltage or AC voltage is applied to the capacitive type electrode 7 by the electric power supply source 6, glow discharge occurs between the electrodes 7 and 4, decomposing the silicon compound, and thus an a-SiH film is formed on the substrate 3.

For the formation of an impurity-added a-SiH film, an impurity-forming gas is introduced from the gas cylinder 12 or 13 through the valves 18 and 19 into the vessel 2 during the formation of the a-SiH film. In this case, the amount of the impurity being doped in the a-SiH film can be controlled by the amount of the gas being introduced into the vessel 2.

After the a-SiH film having the desired film thickness and characteristics is formed on the substrate 3, the vessel 2 is restored by a leak valve 28 and the a-SiH film is taken out.

Although the above explanation has been made particularly with respect to the formation of the a-SiH film by high frequency capacitive type glow discharge, a-SiH film-forming using high frequency industive type (as described in detail, for example, in Advances Physics, 1977 Vol. 26, No. 6, pages 811–845), DC double-pole type, or the like glow discharge can be used.

The a-SiH thin film can also be produced by the high frequency sputtering method. By the term "high frequency sputtering" is meant a method in which the sputtering is carried out by impulse ions generated by high frequency (e.g., radio wave, ultraviolet ray, x-ray, $\gamma$-ray). When hydrogen gas is introduced at the high frequency sputtering, silicon released by the impulse ions and/or a part of silicon deposited on the substrate reacts with hydrogen, compensating the defect in the atomic arrangement of a-SiH to be deposited on the substrate.

As a target substance in the sputtering method, non-doped crystalline or amorphous silicon having a purity of 9N or more is used. The hydrogen gas to be mixed with an inert gas (e.g., argon, neon, xenon, krypton, etc.) which is an impulse ion source at the sputtering is from 0.01 to 50 mol%, and preferably from 5 to 40 mol%, based upon the moles of inert gas. Mixing the hydrogen gas within the range of from 7 to 30 mol% is especially preferred to obtain an amorphous silicon thin film having a high specific resistance in a dark place and good photoconductivity.

As a high frequency wave to be applied onto the target support member, a radio wave of 1 to 50 MHz is suitable. Where a negative DC voltage is applied to the substrate, the suitable voltage is about 50 to 500 volts.

In effecting the above high frequency sputtering, the temperature of the substrate is kept within the range of from 200° C. to 300° C.

The difference in the deposit rate of the amorphous silicon thin film exerts no appreciable influences on the characteristics as a light-sensitive layer, and it can be increased to 10 Å/sec or more.

When the a-SiH thin film is formed on the substrate by the sputtering method, a known high frequency sputtering apparatus, as described in detail, for example, in Chopra, *Thin Film Phenomena,* pp. 34 to 43, McGraw Hill Book Co., N.Y. (1969) can be used.

Figure 7:
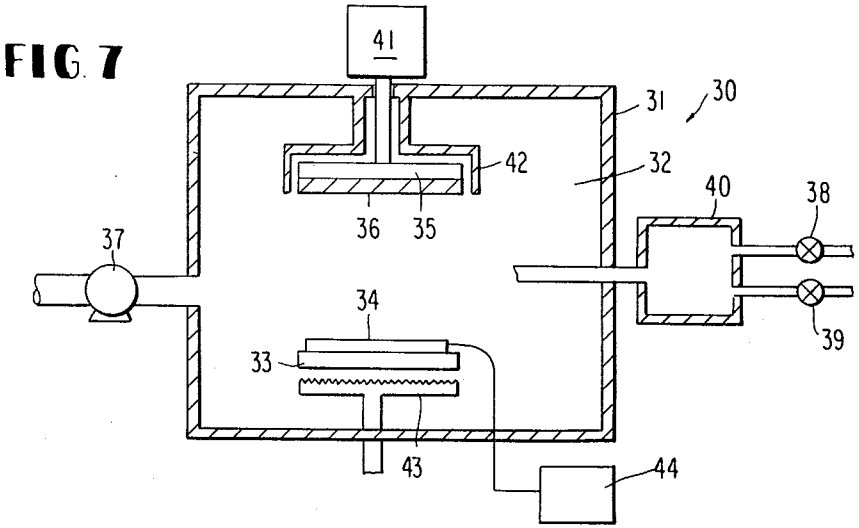
FIG. 7 is an example of a sputtering apparatus.

Referring to an illustrative sputtering apparatus as illustrated in FIG. 7, a method of forming an a-SiH film will be explained.

A substrate 34 is placed on a substrate support member 33 installed in a vacuum chamber 32 which is partitioned by a wall 31, and a silicon target 36 is placed on a target support member 35 which is provided at a position spaced away from and facing the substrate support member 33.

The vacuum chamber 32 is evacuated by use of an exhaust pump 37 so that the back pressure be preferably $1\times10^{-6}$ Torr or less. Then, an inert gas which becomes an impulse ion source at the time of sputtering is introduced into the vacuum chamber 22 through a leak valve 38, and a hydrogen gas, through a leak valve 39. In order to fully mix the inert gas and other gases, it is preferred to provide a mixing chamber 40 before the vacuum chamber 32. The mixed gas of the inert gas and hydrogen gas is introduced into the vacuum chamber 32 to such an extent as to keep the back pressure of the vacuum chamber 32 within the range of $1\times10^{-3}$ Torr to $5\times10^{-2}$ Torr.

Thereafter, a high frequency wave generated by a high frequency wave source 41 is applied onto the target support member 35. While grounding the substrate 34, directly or through the substrate support member 33, or applying negative DC current to prevent secondary electrons of glow discharge from smashing into the deposited product, the sputtering is carried out. In order to avoid the discharge between the target support member 35 and the wall 31, it is preferred to provide a shield 42 around the target support member 35.

The maintenance of the substrate temperature is attained by a temperature maintenance units 43 and 44 installed at the opposite side to the side of the substrate support member 33 at which the substrate is placed. The temperature maintenance units 43 and 44 are usually sufficient to be equipped with a variable heater, and in some cases, it may be used in combination with a cooler. The substrate temperature is measured with a thermocouple 45, the measuring end of which is brought in contact with the surface of the substrate 34 facing the target. By adjusting the temperature maintenance units 43 and 44 (for example, by raising or lowering the heating temperature), the substrate temperature can be maintained in the above described range.

To the inert gas containing the hydrogen gas within the above described concentration range are further added p-type impurities such as B, Al, Ga, In, etc., as a metal vapor or a gas of a corresponding compound, or n-type impurities such as P, As, Sb, Bi, etc., as a metal vapor or a gas of a corresponding compound in a ratio of $1\times10^{-6}$ to 5 mol% based upon the inert gas. On carrying out the sputtering of Si in the above mixed gas at a substrate temperature of from 50° C. to 300° C., a-SiH having good photoconductive characteristics is obtained.

The electric charge transport layer as used in this invention comprises a semiconductor material which has a specific resistance in darkness of $10^{10}$ Ω·cm or more, and preferably $10^{13}$ Ω·cm or more, and has substantially no photoconductivity with respect to visible light and infrared light, and which is a good conductor for electron or positive hole carriers.

In general, a specific resistance in darkness of up to about $10^{14}$ Ω·cm is convenient for the production.

Where imagewise exposure is applied from the side of the electric charge transport layer, a semiconductor is used which has an optical window effect onto the a-SiH light-sensitive layer and has an optical absorption edge of 1.5 eV or more, and preferably 2 eV or more.

In general, those having optical absorption edges of up to about 5 eV can be easily obtained.

For the electric charge transport layer to be laminated on the light-sensitive layer, it is desired that no barrier or surface level against electron or positive hole carriers light-excited in the light-sensitive layer be formed in the interface between the light-sensitive layer and the electric charge transport layer; that is, the carriers are efficiently injected from the light-sensitive layer to the electric charge transport layer, and that the mobility and life of the carriers in the electric charge transport layer are great; that is, the carriers are not trapped and can efficiently pass through the electric charge transport layer.

Where Se or CdS is used in the electric charge-generating layer, as electric charge carriers to form electric charge transport layers which permit effective injection of electric charges therein, many substances such as trinitrofluorenon (TNF), poly-N-vinyl carbazole (PVK), etc. are known. However, where the a-SiH is used in the electric charge-generating layer, all of the electric charge carriers substances suitable for the electric charge-generating layer made up of Se, Cds, or the like are not always suitable. It has now been revealed that to obtain a function separated type light-sensitive member of high sensitivity and low residual potential, specific electric charge carriers should be used.

To obtain a high sensitive electrophotographic light-sensitive member comprising two layers of a-SiH and an electric charge transport medium, it is necessary to laminate an electric charge generating layer comprising n-type or intrinsic conduction type a-SiH and at least one positive electric charge transport carrier selected from the group consisting of pyrazolines, arylalkanes, arylketones, arylamines and chalcones. In the function separated type light-sensitive member of such a combination, of the carriers formed in the a-SiH by irradiation with electromagnetic wave, positive electric charges are effectively injected into the electric charge transport layer and move therethrough, permitting a reduction of charging potential. Thus, the potential charge on the surface is sufficiently lowered by imagewise exposure to from 5 to 10 Lux, and it is possible to obtain a clear toner image by toner development.

The pyrazolines can be represented by the following general formula:

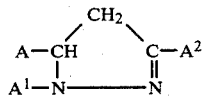

wherein A and $A^1$ are each aryl groups, $A^2$ is styryl or aryl group, said aryl groups of A, $A^1$ and $A^2$ and styryl group may be substituted with at least one of electron donating groups.

In this formula it is preferred that the materials may be classified chemically as styryl pyrazolines. It is also preferred that one or more of the aryl groups be substituted, most preferably with groups known in the art to be electron donating groups. The most preferred substituent groups are methoxy, ethoxy, dimethyl amino, diethyl amino and the like. It is not preferred to substitute the aryl groups with electron withdrawing groups such as nitro and cyano.

The arylalkanes can be represented by the following general formula:

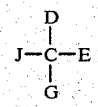

wherein each of D and E is an aryl group and G and J are each a hydrogen atom, an alkyl group, or an aryl group, at least one of those aryl groups containing an amino substituent. The aryl groups attached to the central carbon atoms are preferably phenyl groups, although naphthyl groups can also be used. Such aryl groups can contain such substituents as alkyl and alkoxy typically having 1 to 8 carbon atoms, hydroxy, halogen, etc., in the ortho, meta or para positions, ortho-substituted phenyl being preferred. The aryl groups can also be joined together or cyclized to form a fluorene moiety, for example. The amino substituent can be represented by the formula

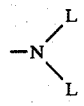

wherein each L can be an alkyl group typically having 1 to 8 carbon atoms, a hydrogen atom, an aryl group, or together the necessary atoms to form a heterocyclic amino group typically having 5 to 6 atoms in the ring such as morpholine, pyridyl, pyrryl, etc. At least one of D, E, and G is preferably p-dialkylaminophenyl group. When J is an alkyl group, such an alkyl group more generally has 1 to 7 carbon atoms.

The chalcones can be represented by the following general formula:

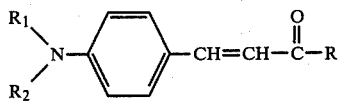

wherein $R_1$ and $R_2$ are each phenyl radicals including substituted phenyl radicals and particularly when $R_2$ is a phenyl radical having the formula:

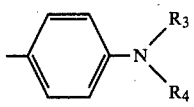

wherein $R_3$ and $R_4$ are each aryl radicals, aliphatic residues of 1 to 12 carbon atoms such as alkyl radicals preferably having 1 to 4 carbon atoms or hydrogen. Particularly advantageous results are obtained when $R_1$ is a phenyl radical including substituted phenyl radicals and where $R_2$ is a diphenylaminophenyl, dimethylaminophenyl or phenyl.

Electric charge carrier substances effective in this invention include the following:

Pyrazolines such as 1,3,5-triphenylpyrazoline, 1-phenyl-3-(p-dimethylaminostyryl)-5-(p-dimethylaminophenyl)-pyrazoline, 1-phenyl-3-(p-methoxystyryl)-5-(p-methoxyphenyl)-pyrazoline, 1-phenyl-3-styryl-5-phenylpyrazoline, 1-phenyl-3-phenyl-5-(p-dimethylaminophenyl)-pyrazoline, etc.; triaryl- or diarylmethanes such as leuco-malachite green, leucocrystal violet, tetrabase, etc.; triarylmethanes as described in U.S. Pat. No. 3,542,547, such as 4,4'-benzylidenebis(N,N-diethyl-m-toluidine), 2',2''-dimethyl-4,4',4''-tris(dimethylamino)-triphenylmethane, etc.; diarylalkane compounds as described in U.S. Pat. No. 3,615,402, such as 2,2-bis(4-N,N-dimethylaminophenyl)-propane, 1,1-bis(4-N,N-dimethylaminophenyl)cyclohexane, etc.; tetraarylmethane or triarylalkane compounds as described in U.S. Pat. No. 3,542,544, such as bis(4-di-methylamino)-1,1,1-triphenylethane, 4-dimethylaminotetraphenylmethane, etc.; chalcones and diarylketones such as 4-N,N-dimethylaminophenyl-4'-N,N-dimethylaminostyrylketone, 1-(p-N,N-dimethylaminobenzoyl)-4-(p-N,N-dimethylaminophenyl)-butadiene-1,3-di(p-N,N-dimethylaminostyryl)ketone, di(p-N,N-diethylaminophenyl)ketone, etc.; arylamines such as p-N,N-dimethylaminostilbene, p,p'-N,N,N',N'-tetramethyldiaminostilbene, diarylamines such as diphenylamine, dinaphthylamine, N,N'-diphenylbenzidine, N-phenyl-1-naphthylamine, N-phenyl-2-naphthylamine, N,N'-diphenyl-p-phenylenediamine, 2-carboxy-5-chloro-4'-methoxydiphenylamine, p-anilinophenol, N,N'-di-2-naphthyl-p-phenylenediamine, those described in Fox U.S. Pat. No. 3,240,597, and the like; triarylamines including (a) nonpolymeric triarylamines, such as triphenylamine, N,N,N',N'-tetraphenyl-m-phenylenediamine, 4-acetyltriphenylamine, 4-hexanoyltriphenylamine, 4-lauroyltriphenylamine, 4-hexyltriphenylamine, 4-dodecyltriphenylamine, 4,4'-bis(diphenylamino)benzil, 4,4'-bis(diphenylamino)benzophenone and the like, and (b) polymeric triarylamines such as poly[N,4'']polysebacyltriphenylamine, polydecamethylenetriphenylamine, poly-N-(4-vinylphenyl)diphenylamine, poly-N-(vinylphenyl), $\alpha,\alpha'$-dinaphthylamine and the like. Other useful amine-type photoconductors are disclosed in U.S. Pat. No. 3,180,730 issued Apr. 27, 1965.

Of the above compounds, 1,3,5-triphenylpyrazoline, 1-phenyl-3-(p-dimethylaminostyryl)-5-(dimethylaminophenyl) pyrazoline, 1-phenyl-3-(p-methoxystyryl)-5-(p-methoxyphenyl) pyrazoline, 1-phenyl-3-styryl-5-phenylpyrazoline, 1-phenyl-3-phenyl-5-(p-dimethylaminophenyl)pyrazoline, 4,4'-benzylidene-bis(N,N-dimethyl-m-toluidine), 1,1-bis(4-N,N-dimethylaminophenyl)-4-methylchlorohexane, and tri(p-tolyl)amine are excellent in that they provide light-sensitive members of very high sensitivity.

When other organic carriers such as polyvinyl carbazoles, etc., are used in combination with a-SiH, the residual potential is very high, and thus they are not preferred for use as electric charge carriers for the function separated type light-sensitive member including the electric charge-generating layer made up of a-SiH.

A solution of one or more of the above described compounds or a dispersion prepared by dispersing in a polymer solution is coated on the support or the a-SiH layer and dried to form the electric charge transport layer. As polymers for use in the polymer solutions, insulating polymers such as polycarbonates, acrylate polymers, vinyl polymers, cellulose polymers, polyesters, polysiloxanes, polyamides, polyurethanes and epoxides, and random copolymers, alternating copolymers and block copolymers thereof, etc. can be used.

The organic electric charge carrier content is generally from $0.1\times10^{-3}$ to $10\times10^{-3}$ mol, and preferably from $0.8\times10^{-3}$ to $2\times10^{-3}$ mol per gram of the polymer.

The insulating polymer is dissolved or dispersed in a solvent capable of dissolving at least the insulating polymer. As such solvents, those solvents capable of dissolving at least the polymers used are used, and a suitable solvent can be selected from a number of solvents. Taking into consideration the removal of solvent, etc., those solvents having boiling points of about 30° C. to about 200° C. are preferred. Examples of suitable solvents include alcohols such as methanol, ethanol, isopropanol, etc., aliphatic ketones such as acetone, methyl ethyl ketone, cyclohexanone, etc., amides such as N,N-dimethylforamide, N,N-dimethylacetoamide, etc., ethers such as dimethylsulfoxide, tetrahydrofuran. dioxane, ethyleneglycol monomethyl ether, etc., esters such as methyl acetate, ethyl acetate, etc., halogenated hydrocarbons such as chloroform, methylene chloride, ethylene dichloride, carbon tetrachloride, trichloroethylene, etc., hydrocarbons such as benzene, toluene, xylene, ligroin, etc., water and so on. These solvents may be used alone or in combination with each other.

The amount of the insulating polymer added is generally from about 0.5 g to 0.005 g, and preferably from 0.1 to 0.01 g, per milliliter of the solvent.

The thickness of the electric charge transport layer is generally 1 to 100$\mu$ and preferably 5 to 20$\mu$.

When the thickness of the electric charge transport layer is less than 1$\mu$, a sufficient effect as an electric charge transport layer sometimes cannot be obtained. On the other hand, it is not necessary to increase the thickness to more than 100$\mu$.

The electric charge blocking layer as used in this invention forms a barrier against electron and/or positive hole carriers, preventing the injection of electric charges into the light-sensitive layer, and it is made of an insulating material, such as $SiO_2$, SiO, $SiN_x$ (x: 0.1–4), $SiC_x$ (x: 0.1–4), $Al_2O_3$, $ZrO_2$, $TiO_2$, $MgF_2$, ZnS and the like, a semiconductor which belongs to a different electroconductive type from a-SiH layer, and an organic polymeric compound, such as polycarbonate, polyvinyl butyral and the like. This electric charge blocking layer can be formed by usual methods such as vapor-depositing, sputtering, coating, glow discharge, etc.

The thickness of the electric charge blocking layer is generally 0.005 to 5$\mu$ and preferably 0.01 to 1$\mu$. When the thickness is less than 0.005$\mu$, the effect as an electric charge blocking layer is sometimes insufficient. On the other hand, in thicknesses greater than 5$\mu$, there is no increase in the effect as an electric charge blocking layer.

The light-sensitive member of this invention can be charged by normal corona discharge techniques. The potential which can be charged is 10 to 1000 V, which is generally sufficient for use in electrophotography.

Furthermore, the light-sensitive member of this invention is desirably in the light decay of charged potential by light-irradiation, and thus exhibits excellent electrophotographic characteristics.

By applying a heat-treatment on the function separated type electrophotographic light-sensitive member of this invention, the characteristics of the electrophotographic light-sensitive layer, such as initial charge potential, sensitivity, residual potential, etc., can be improved. This heat-treatment is carried out as follows:

(1) After the composition for forming the electric charge transfer layer is coated on the a-SiH layer, the heat-treatment is immediately carried out while at the same time evaporating the solvent at from 100° C. to 200° C. for 1 minute to 300 minutes. Preferred heating temperature and time are respectively from 120° C. to 180° C. and from 5 minutes to 60 minutes.

(2) After the composition for forming the electric charge transfer layer is coated, it is first dried and thereafter the temperature is raised to from 100° C. to 200° C., at which temperature the heat treatment is carried out for from 10 seconds to 10 hours. Preferred heating temperature and time are respectively from 120° C. to 180° C. and from 1 minute to 60 minutes. The drying temperature and time are generally from 50° C. to 80° C. for from 10 minutes to 300 minutes, respectively.

The electrophotographic light-sensitive member of this invention can be used in the same manner as in the case of known electrophotographic light-sensitive members. When the top layer of the light-sensitive member is the electric charge transport layer, the light-sensitive member is negatively charged, whereas when the top layer is the a-SiH layer, it is positively charged. This charging has no relationship with the presence of the blocking layer.

Figure 8:
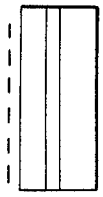
FIG. 8 illustrates the changes in the surface of a light-sensitive member of this invention by exposure-development in the use thereof.
Figure 8:
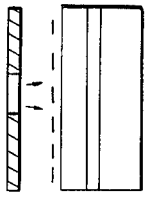
Figure 8:
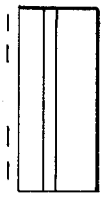
Figure 8:
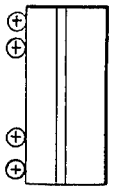
Figure 8:
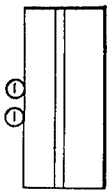

A method of using the light-sensitive member of this invention is schematically illustrated in FIG. 8 by reference with the light-sensitive member as shown in FIG. 1-(*a*). The surface of the light-sensitive member is negatively charged as illustrated in FIG. 8-(*a*) and, thereafter, it is imagewise exposed by use of an original E as illustrated in FIG. 8-(*b*). The exposed areas lose electric charges, forming a latent image of electric charges on the surface of the light-sensitive member as illustrated in FIG. 8-(*c*). On developing the light-sensitive member bearing the latent image so formed, with toners having negative or positive electric charges by, for example, the cascade method or a liquid developer containing negatively or positively charged particles, a negative or positive image is formed as illustrated in FIGS. 8-(*d*) and 8-(*d'*).

The following examples are given to illustrate this invention in greater detail.

EXAMPLE 1

On a 10 cm×10 cm (1 mm thick) stainless steel plate and a 2.5 cm×2.5 cm (1 mm thick) alkali-free glass substrate, which had been cleaned by use of a fluorene cleaning apparatus, was each vapor-deposited an a-SiH (n) film by use of a glow discharge equipement as illustrated in FIG. 6.

The glass substrate was fixed on the substrate fixing member 4. The main valve 24 was fully opened to evacuate the air in the vapor-depositing chamber 2 and furthermore, the valve 23 was opened to attain a degree of vacuum of $3\times10^{-6}$ Torr in the chamber 2. The substrate was then raised in temperature to 250° C. by uniformly heating with the heater 5 and maintained at that temperature. The main valve 24 was closed and subsequently, the needle valve 17 connecting to the cylinder 11 was gradually opened to introduce a mixed gas of argon and 20 vol% of $SiH_4$ into the chamber 2 from the cylinder 11. When the gas pressure in the chamber 2 reached about $10^{-1}$ Torr, the valve 26 was opened and furthermore the needle valve 17 was regulated to maintain the degree of vacuum in the chamber 2 at about 0.2 Torr.

Thereafter, the high frequency electric power supply source 6 was switched on and high frequency of 13.56 MHz was applied onto the electrode 7, causing glow discharge. Thus, as a result of the glow discharge, an a-SiH layer was formed on each of the stainless steel and alkali-free glass substrates. At this time, the glow discharge current was about 0.5 mA/cm$^2$ and the voltage, 1,000 V. The growth rate of the a-SiH layer was about 3 A/sec, and by carrying out the vapor-deposit for 30 minutes, a 0.54$\mu$ thick a-SiH film was formed on each of the above substrates. After the vapor-deposit was completed, the needle valve 17 and the valve 26 were closed and the valve 28 was opened to return the pressure in the chamber 2 to atmospheric pressure, and then the substrate having the a-SiH film was removed.

On the a-SiH film provided on the alkali-free glass were further vapor-deposited a NiCr electrode having a thickness of about 1,000 Å, and a gold layer having a thickness of 500 Å, by use of a comb-shaped vapor-depositing mask, and the resistance in darkness and light resistance of the a-SiH film were measured. The resistance in darkness was about $10^8\Omega\cdot$cm. The light resistance to xenone lamp light of 10 mW in which the long wave length region exceeding 800 nm was cut, was $10^4$ $\Omega\cdot$cm. The activation energy of the film was about 0.65 eV and the thermoelectromotive force was negative value, and therefore the Fermi level was nearer the conduction level and it exhibited n-type conduction.

The a-SiH (n) film provided on the stainless steel substrate had similar characteristics. Examination of the electrophotographic characteristics of the a-SiH on the stainless steel substrate revealed that it was not charged and could not be used as it is as an electrophotographic light-sensitive member.

A coating solution having a formulation of 1 g of polycarbonate, $1.6\times10^{-3}$ mol of 1-phenyl-3-p-dimethylaminostyryl-5-p-dimethylaminophenyl pyrazoline and 2 ml of $CH_2Cl_2$ as a solvent was coated on the a-SiH (n) layer provided on the stainless steel substrate and dried to form a 10$\mu$ thick p-type electric charge transport layer, and a function separated type electrophotographic light-sensitive member was thus obtained.

The electric charge carrier is a p-type electric charge transport medium which transports positive electric charges, and the light-sensitive member is provided with light-sensitivity by negatively charging the surface thereof.

On applying on the surface of the light-sensitive member negative corona discharge at an electric source voltage of −7 kV in darkness by use of a charging equipment, the light-sensitive member was charged at −500 V. Thereafter, when irradiation of light of 4 lux.sec was applied, the surface potential was lowered to half, that is, the half decay exposure amount was 4 lux.sec.

The light-sensitive member was charged in darkness at a discharge voltage of −7 kV and then imagewise exposed to a light of 11 lux.sec. Thereafter, on toner-developing with positively charged toners by a magnetic brush developing method, a toner image was obtained. The toner image was transferred to a transfer paper by a transfer method, and a high quality image was thus-obtained which was sharp and of high contrast.

EXAMPLE 2

On a 10 cm×10 cm (1 mm thick) stainless steel substrate and a 2.5 cm×2.5 cm (1 mm thick) alkali-free glass substrate, which had been cleaned by use of a fluorene cleaning equipment, was each vapor-deposited an a-SiH (n) film by use of the glow discharge equipment as illustrated in FIG. 6.

The glass substrate was fixed on the fixing member 4. The main valve 24 was fully opened to evacuate the air in the vapor-depositing chamber 2 and furthermore, the valve 23 was opened to attain a degree of vacuum of $3\times10^{-6}$ Torr in the chamber 2. The substrate was then raised in temperature to 250° C. by uniformly heating with the heater 5 and maintained at that temperature. The main valve 24 was closed and subsequently, the needle valve 17 was gradually opened to introduce a mixed gas of argon and $SiH_4$ (20 vol%) into the chamber 2 from the cylinder 11. Similarly, a mixed gas of argon and $B_2H_6$ (0.1 vol%) was introduced into the chamber 2 from the cylinder 12. At this time, the latter mixed gas was introduced while controlling so that the mol percentage of $B_2H_6$ to $SiH_4$ was $5\times10^{-3}$. When the gas pressure in the chamber reached about $10^{-1}$ Torr, the valve 26 was opened, and the needle valve 17 was regulated so that the degree of vacuum in the chamber 2 be maintained at about 0.2 Torr.

Thereafter, the high frequency electric power supply source 6 was switched on and high frequency of 13.56 MHz was applied onto the electrode 7 to cause glow discharge. Thus, as a result of the glow discharge, an a-SiH layer was formed on each of the stainless steel and alkali-free glass substrates. At this time, the glow discharge current was about 0.5 mA/cm$^2$ and the voltage, 1,000 V. The growth rate of the a-SiH layer was about 3 Å/sec, and by carrying out the vapor-deposit for 30 minutes, 0.54μ thick a-SiH film was formed on each of the above substrates. After the vapor-deposit was completed, the needle valve 17 and the valve 26 were closed and the valve 28 was opened to return the pressure in the chamber 2 to atmospheric pressure, and then the substrates, each having the a-SiH layer, were removed.

With the a-SiH film provided on the alkali-free glass substrate, the specific resistance in darkness was $10^{12}\Omega\cdot$cm, the activation energy, 0.8 eV; and the optical energy gap, 1.65 eV which is about half ot ehe activation energy.

A coating solution having a formulation of 1 g of polycarbonate, $1.6\times10^{-3}$ mol of 2,4,1-phenyl-3-p-dimethylaminostyryl-5-p-dimethylaminophenyl pyrazoline and 2 ml of $CH_2Cl_2$, solvent, was coated on the a-SiH (n) layer provided on the stainless steel substrate and dried to form a 10μ thick p-type electric charge transport layer, and a function separated type electrophotographic light-sensitive member was thus obtained.

On applying on the surface of the light-sensitive member corona discharge at a high voltage of −7 kV, the light-sensitive member was charged at −500 V. The light decay by irradiation with light was measured, and the half decay light amount was found to be 4 lux.sec.

The light-sensitive member was charged by application of corona discharge of −7 kV on the surface thereof and then imagewise exposed by a light of 10 lux. By carrying out the cascade development with positively charged toners, a toner image was obtained. The toner image thus-obtained was transferred to a transfer paper, and a sharp toner image was thus obtained.

EXAMPLE 3

The procedure of Example 2 was followed except that 1-phenyl-3-p-methoxystyryl-5-p-methoxyphenyl pyrazoline was used in place of the electric charge carrier of Example 2, and an electrophotographic light-sensitive member having an electric charge transport layer containing the 1-phenyl-3-p-methoxystyryl-5-p-methoxyphenyl pyrazoline was thus obtained.

On applying to the surface of the light-sensitive member at a voltage of −7 kV, the light-sensitive member was charged at −450 V, and its half decay light amount was 5 lux.sec.

The light-sensitive member was negatively charged and imagewise exposed at a light amount of 13 lux.sec. After the cascade development using positively charged toners, the resulting image was transferred to a transfer paper, and a sharp toner image was thus obtained.

EXAMPLE 4

The procedure of Example 2 was followed, except that 4,4'-benzylidene-bis-N,N-diethylene-m-toluidine was used in place of the electric charge transport carrier of Example 2, and an electrophotographic light-sensitive member having a 5μ thick p-type electric charge transport layer was thus obtained.

On applying to the surface of the light-sensitive member corona discharge at a high voltage of −7 kV, the light-sensitive member was charged at −300 V, and its half decay light amount was 6 lux.sec.

The light-sensitive member was negatively charged by application of corona discharge of −7 kV on the surface thereof and then imagewise exposed by a light amount of 15 lux.sec. After the cascade development using positively charged toners, the resulting image was transferred to a transfer paper, and a sharp image was thus obtained.

EXAMPLE 5

On a stainless steel substrate was vapor-deposited a 500 Å thick $Al_2O_3$ film by an electron beam vapor-deposit method. On this stainless steel substrate, a 0.5μ thick n-type a-SiH film was formed in the same manner as in Example 1. Furthermore, a coating solution having a formulation of 90 mg of polycarbonate (PC), $1.6\times10^{-3}$ mol/g (PC) of 1-phenyl-3-(p-dimethylaminostyryl)-5-(p-methoxyphenyl)-pyrazoline and 1 ml of $CH_2Cl_2$, which was to form an electric charge transport layer, was coated on the above prepared a-SiH film and dried to provide a 5μ thick p-type electric charge transport layer.

Thereafter, the light-sensitive member was negatively charged in darkness by application of corona discharge of −7 kV, and the potential was measured and found to be about −350 V. The half decay of the potential by irradiation with light was observed and found to be about 4 lux.sec.

The light-sensitive member obtained above was charged at −350 V in darkness by application of corona discharge of −7 kV and then imagewise exposed by a light of 10 lux.sec. After the development using positively charged toners according to the magnetic brush developing method, the obtained image was transferred to a transfer paper, and a sharp, good quality image was thus obtained.

EXAMPLE 6

On a 0.1μ thick $In_2O_3$ layer which had been provided on a glass plate was formed a B-doped a-SiH film by use of a glow discharge apparatus as shown in FIG. 6. $B_2H_6$ was mixed with a $SiH_4$-He mixed gas containing 20 vol% of $SiH_4$ so that the ratio of $B_2H_6$ to $SiH_4$ be 0.01 mol%. By using the resulting mixed gas, glow discharge was applied under the conditions of a substrate temperature of 250° C., a gas pressure of 0.15 Torr and a 3.5 MHz high frequency power of 10 W to form a 5,000 Å thick a-SiH film on the glass plate.

The plate with the a-SiH film coated thereon was removed from the glow discharge apparatus. A coating solution having a formulation of 1 g of polycarbonate, $10^{-3}$ mol of a p-type electric charge carrier, 1-phenyl-3-p-methoxystyryl-5-p-methoxyphenyl pyrazoline and 2 ml of $CH_2Cl_2$ was coated on the plate and dried at 60° C. for 1 hour to obtain an electrophotographic light-sensitive member.

This light-sensitive member was 8μ in thickness and its Ė/I was about 1. When the light-sensitive member was heated at 160° C. for 10 minutes, its Ė/I was 10; it was observed that the heat-treatment of this invention increased the sensitivity by one figure.

Ė/I is indicated by the following equation:

$$\dot{E}/I = \Delta E/\Delta T \cdot 1/I = \Delta V/\Delta T \cdot 1/l \cdot 1/I$$

wherein

ΔE: change in intensity of electric field,

ΔT: time (sec),

I: intensity of light (lux), $\Delta V = V_o - V$ (volt), l: thickness of light-sensitive layer (μm)

That is, Ė/I is a value that the initial light decay rate is indicated as a change in intensity of electric field per unit light amount when the initial charged potential is $V_o$, and the surface potential after irradiation of light having an intensity of illumination of I for ΔT (sec) is V.

EXAMPLE 7

A light-sensitive member was produced in the same manner as in Example 6, except that p-type 1-phenyl-3-p-dimethylaminostyryl-5-p-dimethylaminophenyl pyrazoline was used as an electric charge carrier. Ė/I of the light-sensitive member was about 3. When the light-sensitive member was heated at 120° C. for 10 minutes, Ė/I was about 12; an increase in sensitivity was observed, and the residual potential became very small.

EXAMPLE 8

A light-sensitive member was produced in the same manner as in Example 7 except that a 0.6μ thick non-doped a-SiH film produced at a substrate temperature of 200° C. was used. Ė/I of the light-sensitive member was about 1.

When the light-sensitive member was heated at 120° C. for 10 minutes, Ė/I was about 7; an increase in sensitivity was observed.

EXAMPLE 9

On an $In_2O_3$ coated-glass on which $Al_2O_3$ was vapor-deposited in a thickness of 500 Å as a blocking layer by electron beam, a-SiH was deposited in a thickness of 0.6μ from a $SiH_4$ gas containing 0.05% of $B_2H_6$ in the same manner as in Example 6.

In the same manner as in Example 6, an electrophotographic light-sensitive member was produced using as an electric carrier 1-phenyl-3-p-methoxystyryl-5-p-methoxyphenyl pyrazoline. Ė/I of the light-sensitive member was about 2. When the light-sensitive member was heated at 160° C. for 10 minutes, Ė/I was 11; an increase in sensitivity was observed.

EXAMPLE 10

In the same manner as in Example 6, a 0.5μ thick non-doped a-SiH film was provided on a 0.5 mm thick stainless steel plate at a substrate temperature of 250° C. $B_2H_6$ was mixed so that the amount of $B_2H_6$ was 0.02%, based on the amount of $SiH_4$, and a B-doped a-SiH (n) film was provided in a thickness of 300 Å to produce an a-SiH film having a p-n junction in the surface thereof.

Further, in the same manner as in Example 6 except that a p-type electric carrier, 1-phenyl-3-p-methoxystyryl-5-p-methoxyphenyl pyrazoline was used as an electric charge carrier, an electrophotographic light-sensitive member was produced. Ė/I of the light-sensitive member was about 3. When the light-sensitive member was heated at 120° C. for 15 minutes, the sensitivity was about 13; an increase in sensitivity was observed.

While this invention has been described in detail and with reference to specific emobdiments thereof, it will be apparent to one skilled in the art that various changes and modifications can be made therein without departing from the spirit and scope thereof.

What is claimed is:

1. A function separated type electrophotographic light-sensitive member comprising an electrically conductive support having thereon a light-sensitive layer comprising a hydrogen-doped amorphous silicon semiconductor, and an organic electric charge transport layer containing at least one positive charge transport carrier selected from the group consisting of pyrazolines, arylalkanes, arylketones, arylamines and chalcones.

2. A function separated type electrophotographic light-sensitive member as in claim 1 comprising, in sequence, the support, the light-sensitive layer, and the electric charge transport layer.

3. A function separated type electrophotographic light-sensitive member as in claim 1 comprising, in sequence, the support, the electric charge transport layer, and the light-sensitive layer.

4. A function separated type electrophotographic light-sensitive member as claimed in claim 1, wherein an electric charge blocking layer is provided on the hydrogen-doped amorphous silicon semiconductor layer on the side thereof which is not in contact with the electric charge transport layer.

5. A function separated type electrophotographic member as in claim 4 comprising, in sequence, the support, the electric charge blocking layer, the light-sensitive layer, and the electric charge transport layer.

6. A function separated type electrophotographic member as in claim 4 comprising, in sequence, the support, the electric charge transport layer, the light-sensitive layer, and the electric charge blocking layer.

7. A function separated type electrophotographic member as in claim 1, wherein the hydrogen-doped amorphous silicon semiconductor is a film having a thickness of from 0.005μ to 40μ.

8. A function separated type electrophotographic member as in claim 1, wherein the hydrogen-doped amorphous silicon semiconductor contains hydrogen in an amount of from 0.1 to 40 atom %.

9. A function separated type electrophotographic member as in claim 1, wherein the hydrogen-doped amorphous silicon is further doped with at least one member selected from the group consisting of oxygen, nitrogen, halogen and mixtures thereof.

10. A function separated type electrophotographic member as in claim 9, wherein the content of at least one of oxygen, nitrogen and halogen is up to 10 atom %.

11. A function separated type electrophotographic member as in claim 1, wherein the hydrogen-doped amorphous silicon semiconductor contains at least one member selected from the group consisting of N, P, As, Sb, Bi and mixtures thereof as an n-type impurity.

12. A function separated type electrophotographic member as in claim 11, wherein the hydrogen-doped amorphous silicon semiconductor contains at least one member selected from the group consisting of B, Al, Ca, In, Tl and mixtures thereof as a p-type impurity.

13. A function separated type electrophotographic member as in claim 1, 2, 3, 4, 5 or 6 wherein the organic electric charge transport layer comprises an insulating polymer and contains an organic electric charge carrier in an amount of from $0.1\times10^{-3}$ to $10\times10^{-3}$ moles per gram of the polymer.

14. A function separated type electrophotographic member as in claim 1, wherein the organic electric charge transport layer has a thickness of from 1 to 100$\mu$.

15. A function separated type electrophotographic member as in claim 4, wherein the electric charge blocking layer comprises at least one member selected from the group consisting of $SiO_2$, SiO, $SiN_x$ (x: 0.1–4), $SiC_x$ (x: 0.1–4), $Al_2O_3$, $ZrO_2$, $TiO_2$, $MgF_2$, ZnS, a semiconductor which belongs to a different electroconductive type of said hydrogen-doped amorphous silicon semiconductor, polycarbonate, polyvinyl butyral and mixtures thereof.

16. A function separated type electrophotographic member as in claim 4, wherein the electric charge blocking layer has a thickness of from 0.005 to 5$\mu$.

17. A process for producing a function separated type electrophotographic light-sensitive member, said process comprising providing on an electrically conductive support, a light-sensitive layer comprising a hydrogen-doped amorphous silicon semiconductor, and an organic electric charge transport layer containing at least one positive charge transport carrier selected from the group consisting of pyrazolines, arylalkanes, arylketones, arylamines and chalcones, and thereafter heat-treating the thus-produced laminated product at a temperature of from 100° C. to 200° C.

18. A process for producing a function separated type electrophotographic light-sensitive member as in claim 17, wherein the heat-treatment is carried out at from 100° C. to 200° C. for from 1 minute to 300 minutes after coating a composition for forming the electric charge transport layer on the light-sensitive layer, while simultaneously evaporating a solvent contained in the composition.

19. A process for producing a function separated type electrophotographic light-sensitive member as in claim 17, wherein the heat-treatment is carried out after coating and drying the composition for forming the electric charge transport layer for from 10 seconds to 10 hours.

20. A function separated type electrophotographic light-sensitive member as in claim 7 wherein the film thickness of the hydrogen-doped amorphous silicon semiconductor is less than 3$\mu$.

21. A function separated type electrophotographic light-sensitive member as in claim 8 wherein the hydrogen-doped amorphous silicon semiconductor contains hydrogen in an amount of from 10 to 25 atom %.

22. A function separated type electrophotographic light-sensitive member as in claim 13 wherein the organic electric charge transport layer comprises an insulating polymer and contains an organic electric charge carrier in an amount from $0.8\times10^{-3}$ to $2\times10^{-3}$ mol/g of the polymer.

23. A function separated type electrophotographic member as in claim 14 wherein the organic electric charge transport layer has a thickness of from 5 to 20$\mu$.

24. A function separated type electrophotographic light-sensitive member as in claim 7 wherein the film thickness of the hydrogen-doped amorphous silicon semiconductor is from 0.1 to 1$\mu$.

25. A function separated type electrophotographic light-sensitive member as in claim 1 wherein said pyrazolines are represented by the following general formula:

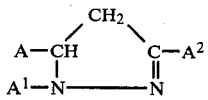

wherein A and $A^1$ are each aryl groups, $A^2$ is styryl or aryl group, said aryl groups of A, $A^1$ and $A^2$ and styryl group may be substituted with at least one of electron donating groups.

26. A function separated type electrophotographic light-sensitive member as in claim 1 wherein said arylalkanes are represented by the following general formula:

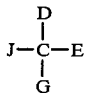

wherein each of D and E is an aryl group, G and J are each a hydrogen atom, an alkyl group, or an aryl group, and at least one of said aryl groups contain amino substituent, said aryl group may be substituted with an alkyl group having 1 to 8 carbon atoms, an alkoxy group having 1 to 8 carbon atoms, a hydroxy group, and a halogen, said aryl groups may be joined together or cyclized to form fluorene moiety, and said amino substituent can be represented by the formula:

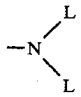

wherein L may be an alkyl group having 1 to 8 carbon atoms, a hydrogen atom, an aryl group, or necessary atoms to form a heterocyclic amino group having 5 to 6 atoms in the ring.

27. A function separated type electrophotographic light-sensitive member as in claim 1 wherein said chalcones are represented by the following general formula:

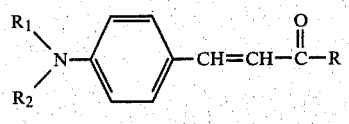
wherein $R_1$ and $R_2$ are each phenyl radicals including substituted phenyl radicals and particularly when $R_1$ is a phenyl radical having the formula:
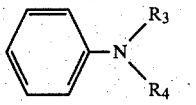
wherein $R_3$ and $R_4$ are each aryl radicals, aliphatic residues of 1 to 12 carbon atoms such as alkyl radicals preferably having 1 to 4 carbon atoms or hydrogen.
* * * * *